US008712610B2

(12) United States Patent
Kumar

(10) Patent No.: US 8,712,610 B2
(45) Date of Patent: Apr. 29, 2014

(54) SYSTEM AND METHOD FOR DETERMINING A CHARACTERISITIC OF AN OBJECT ADJACENT TO A ROUTE

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 1211 days.

(21) Appl. No.: 12/212,717

(22) Filed: Sep. 18, 2008

(65) Prior Publication Data

US 2010/0070172 A1 Mar. 18, 2010

(51) Int. Cl.
*G05D 1/00* (2006.01)

(52) U.S. Cl.
USPC ..... 701/19

(58) Field of Classification Search
USPC ..... 701/207; 348/42, 148
See application file for complete search history.

(56) References Cited

U.S. PATENT DOCUMENTS

| | | | | |
|---|---|---|---|---|
| 5,627,508 | A | 5/1997 | Cooper et al. | |
| 6,088,635 | A | 7/2000 | Cox et al. | |
| 6,141,611 | A | 10/2000 | Mackey | |
| 6,630,884 | B1 | 10/2003 | Shanmugham | |
| 6,714,738 | B2 | 3/2004 | Kato et al. | |
| 6,829,430 | B1 | 12/2004 | Ashizaki et al. | |
| 6,954,224 | B1 | 10/2005 | Okada et al. | |
| 7,127,348 | B2 | 10/2006 | Smitherman et al. | |
| 2004/0104997 | A1* | 6/2004 | Versavel | 348/42 |
| 2006/0244830 | A1* | 11/2006 | Davenport et al. | 348/148 |

* cited by examiner

*Primary Examiner* — John Pauls
(74) *Attorney, Agent, or Firm* — GE Global Patent Operation; John A. Kramer

(57) ABSTRACT

A system is provided for determining at least one characteristic of an object positioned adjacent to a route. The characteristic of the object is related to the operation of a powered system. The powered system travels along the route. The system includes a plurality of cameras attached to the powered system. The plurality of cameras are aligned along a respective line of sight to the object. A method and computer readable media are also provided for determining at least one characteristic of an object positioned adjacent to a route.

31 Claims, 12 Drawing Sheets

SYSTEM AND METHOD FOR DETERMINING A CHARACTERISITIC OF AN OBJECT ADJACENT TO A ROUTE

BACKGROUND OF THE INVENTION

In conventional locomotive imaging systems, a camera collects video information of the locomotive or surrounding railroad system, which is then typically stored in a memory of a processor. Generally, the camera is at a fixed position and fixed angle, but may be manually adjustable. Thus, an operator may manually adjust the single camera to collect video from an upcoming object, such as a railroad signal, for example. The processor, which is coupled to the camera, may attempt to determine the color of the railroad signal, for purposes of controlling the operation of the locomotive, such as determining whether to continue along a portion of the railroad track, for example.

Since these conventional locomotive imaging systems include a single camera which is at a fixed position and orientation (but may be manually adjusted), these systems have unique shortcomings. For example, the camera may not be oriented in the same direction as the information (e.g., wayside signal condition) viewed by an operator or a conductor. Additionally, if an obstacle obstructs the single camera from collecting video data from the object, no video data can be collected. Still further, the single camera is only capable of collecting video data from one particular frame of reference, which may not convey the desired video data. Also, any video data collected by the single camera or data derived therefrom cannot be compared with any reference data to verify its accuracy. Thus, it would be advantageous to provide a locomotive imaging system that avoids these notable shortcomings of conventional locomotive imaging systems.

BRIEF DESCRIPTION OF THE INVENTION

One embodiment of the present invention provides a system for determining at least one characteristic of an object positioned adjacent to a route. The characteristic of the object is related to the operation of a powered system. The powered system travels along the route. The system includes a plurality of cameras attached to the powered system. The plurality of cameras are aligned along a respective line of sight to the object.

Another embodiment of the present invention provides a method for determining at least one characteristic of an object positioned adjacent to a route. The characteristic of the object is related to the operation of a powered system. The powered system travels along the route. The method includes attaching a plurality of cameras to the powered system. The method further includes aligning the plurality of cameras along a respective line of sight to the object.

Another embodiment of the present invention provides computer readable media containing program instructions operable with a processor for determining at least one characteristic of an object positioned adjacent to a route. The characteristic of the object is related to the operation of a powered system. The powered system travels along the route. A plurality of cameras are attached to the powered system. The computer readable media includes a computer software module for aligning the plurality of cameras along a respective line of sight to the object.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles (OHV), marine vessels, agricultural vehicles, and transport buses, each which may use at least one diesel engine, or diesel internal combustion engine. Towards this end, when discussing a specified mission, this includes a task or requirement to be performed by the diesel powered system. Therefore, with respect to railway, marine, transport vehicles, agricultural vehicles, or off-highway vehicle applications this may refer to the movement of the system from a present location to a destination. Likewise, operating conditions of the diesel-fueled power generating unit may include one or more of speed, load, fueling value, timing, etc. Furthermore, although diesel powered systems are disclosed, those skilled in the art will readily recognize that embodiments of the invention may also be utilized with non-diesel powered systems, such as but not limited to natural gas powered systems, bio-diesel powered systems, etc. Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

Figure 1:
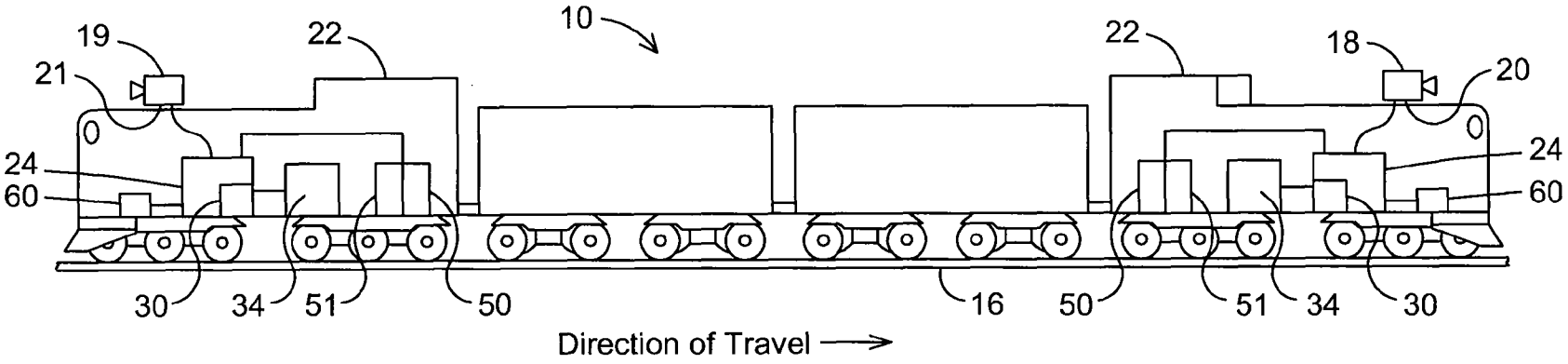
FIG. 1 is a side view of a locomotive within a system for processing images of wayside equipment, according to an exemplary embodiment of the present invention.
Figure 2:
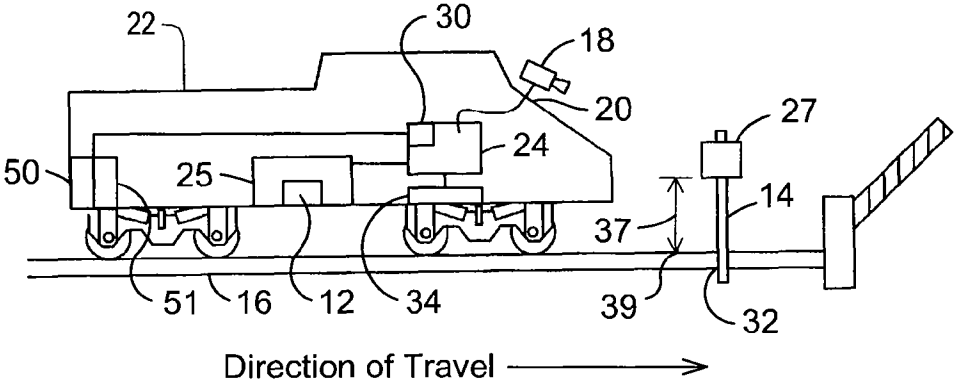
FIG. 2 is a side view of an exemplary embodiment of a locomotive within the system for processing images of wayside equipment illustrated in FIG. 1.

FIGS. 1-2 illustrate an embodiment of a system 10 for processing images 12 of wayside equipment 14 adjacent to a railroad 16. The system 10 includes a controller 24 within a locomotive 22. FIG. 1 illustrates a distributive power arrangement, in which two locomotives 22 are separated by a plurality of train cars, while FIG. 2 illustrates a single locomotive arrangement. The embodiments of the present invention discussed herein are not limited to either of the arrangements illustrated in FIGS. 1 and 2. A plurality of video cameras, such as a forward looking camera 18 and a rearward looking camera 19 are positioned on a respective front and rear external surface 20,21 of the locomotive(s) 22. Although FIGS. 1-2 illustrate the cameras 18,19 being positioned on a respective external surface 20,21 of the locomotive 22, the cameras need not be positioned on an external surface of the locomotive, but instead may merely be attached to any portion of the locomotive 22, such as within an inner recess, for example. Each video camera 18,19 is configured to collect visible spectral data (or possibly other image data) of the wayside equipment 14 as the locomotive 22 travels along the railroad 16. The controller 24 is coupled to the video camera 18 (FIG. 2), or alternatively, a respective controller 24 may be coupled to each video camera 18,19 (FIG. 1), to process the visible spectral data. Additionally, the controller 24 is configured to transmit a signal to a locomotive engine 50 based upon processing the visible spectral data, and this signal may be used to change the operating mode of the locomotive 22, as described below.

Figure 4:
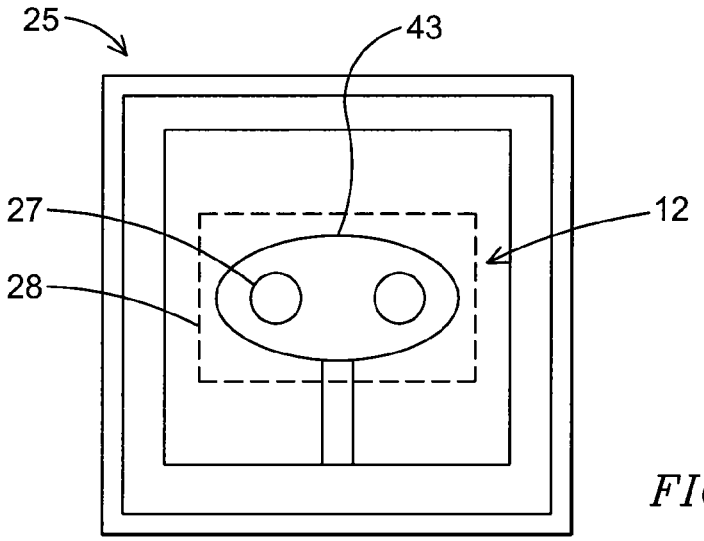
FIG. 4 is a plan view of a display from the system for processing images of wayside equipment illustrated in FIG. 1.

As illustrated in FIG. 2, the wayside equipment 14, whose spectral data is collected and processed by the video cameras 18,19 and controller 24, may be a light signal or a track number indicator for the locomotive 22, for example. For marine applications, the wayside equipment 14 may be a buoy, for example. For OHV, transport buses, and agricultural vehicles, the wayside equipment 14 may be a signal such as a light signal or a signal indicating a parameter of the route, for example. As illustrated in FIG. 4, a display 25 (FIG. 2) shows the images 12 of the wayside equipment 14 subsequent to the collection of spectral data from the wayside equipment 14 by the video cameras 18,19. Each video camera 18,19 may be configured to process pixels within an adjustable field of view 28 (see FIG. 4), where the adjustable field of view of the video camera is adjusted to coincide with some or all of the wayside equipment 14. For example, in the exemplary embodiment of FIG. 4, the adjustable field of view 28 of the video cameras 18,19 is adjusted such that the light signal portion 27 (FIG. 2) of the wayside equipment 14 is visible on the display 25.

Additionally, as illustrated in FIGS. 1-2, the controller 24 includes a memory 30 configured to store one or more expected positions 32 of the wayside equipment 14 along the railroad 16. For example, the memory 30 may store one or more distances for a particular track number from a fixed position, and thus the locomotive operator may retrieve these stored distances to determine the positions of the wayside equipment 14. Additionally, the memory 30 may store one or more position coordinates of the wayside equipment 14, and the system 10 may include a position determination device, such as a GPS (global positioning system) device, for example, coupled to the controller 24 to determine a position of the locomotive 22 along the railroad 16. (The GPS device may be one of several communications equipment components 34 carried on board the locomotive 22, for wireless communications or otherwise, including for example ISCS (International Satellite Communications System), satellite, cellular, and WLAN (wide local area network) components.) The controller 24 is configured to compare the stored position coordinates of the wayside equipment 14 with the present position of the locomotive 22 based on the GPS device or other position determination device. Once the locomotive 22 reaches the expected position 32 (or upon approaching the expected position 32) of the wayside equipment, the controller 24 arranges for the video cameras 18,19 to collect the visible spectral data of the wayside equipment 14. In collecting the visible spectral data of the wayside equipment 14, the field of view 28 (FIG. 4) of the video cameras 18,19 are adjusted to collect the visible spectral data of the wayside equipment 14 positioned at the expected position 32.

Figure 3:
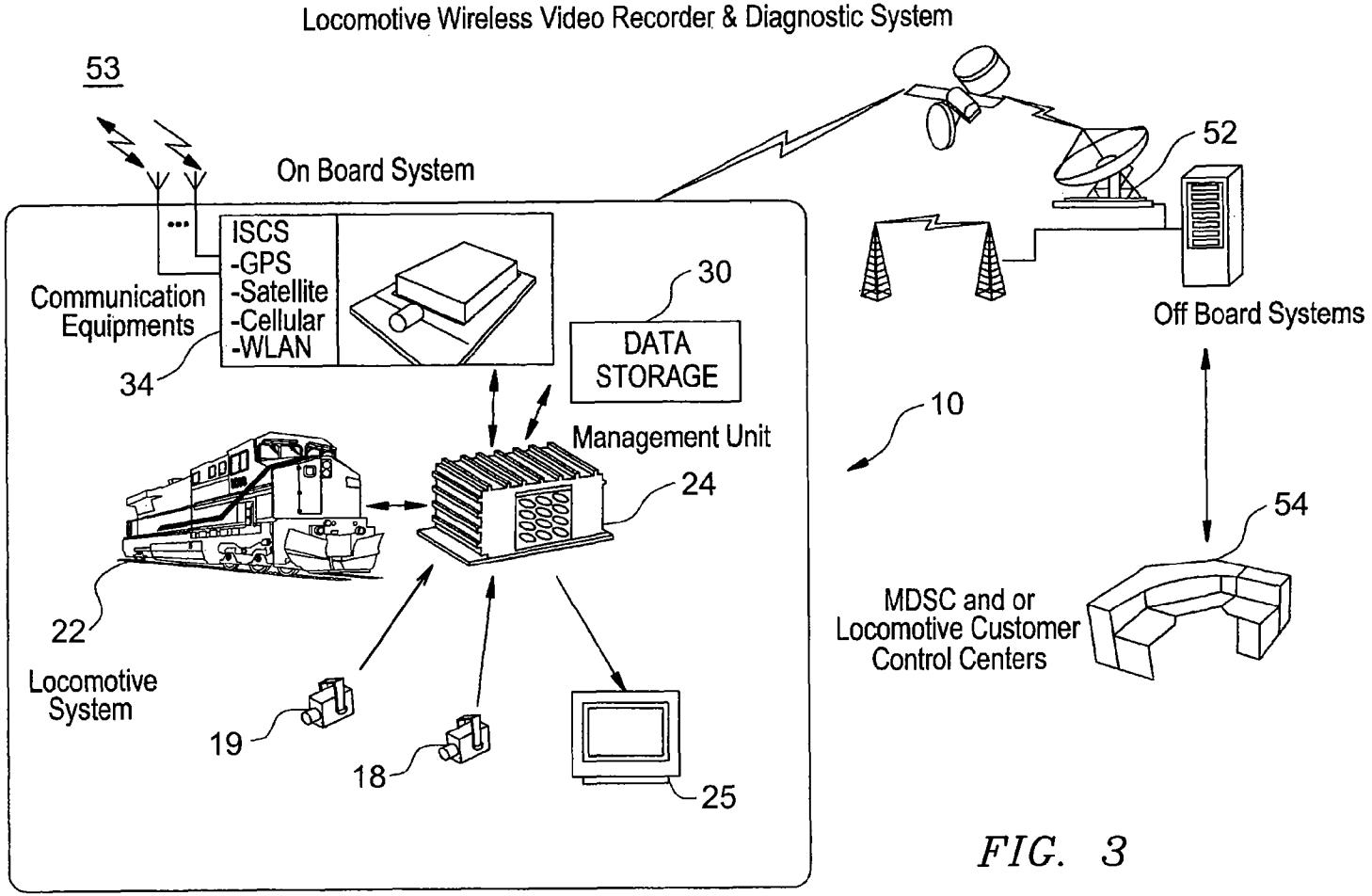
FIG. 3 is a schematic view of an exemplary embodiment of a system for processing images of wayside equipment according to the present invention.

FIG. 3 illustrates an exemplary embodiment of a system 10 and the communications between the (on-board) system 10 and external devices, such as a satellite receiver 52 and/or a command center 54, for example. (As indicated in FIG. 3, the command center 54 may be, for example, a locomotive customer control center or a MDSC (Monitoring and Diagnostics Service Center)). The satellite receiver 52 may provide position information of the locomotive 22 to a transceiver 53 on the locomotive 22, which is then communicated to the controller 24. The progress of the locomotive 22, in terms of properly processing spectral data of each wayside equipment 14 at each expected position 32 may be externally monitored (automatically or manually by staff) by the command center 54.

Figure 5:
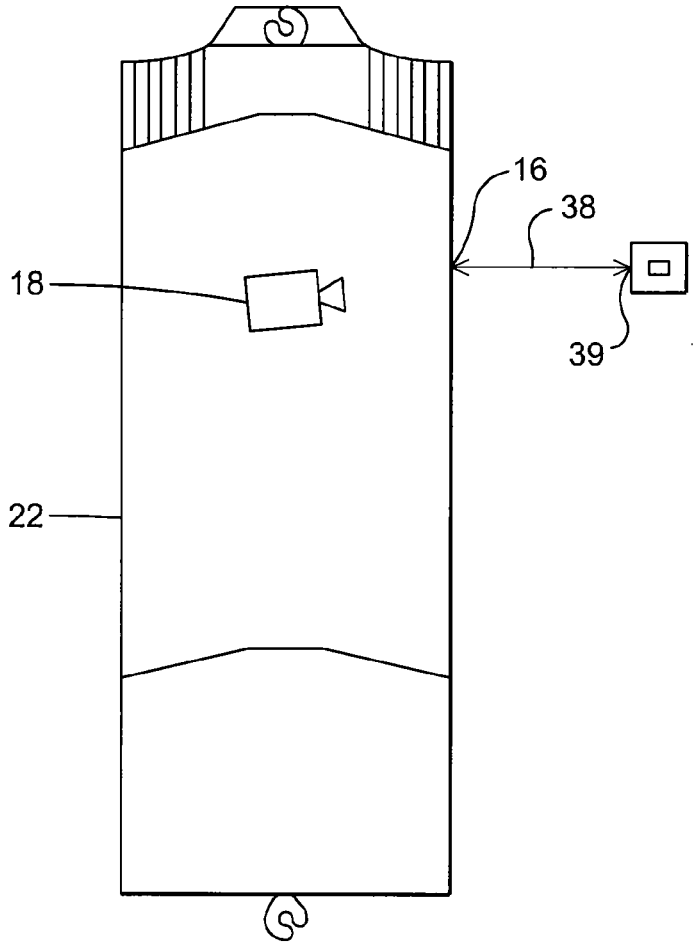
FIG. 5 is a top view of an exemplary embodiment of a locomotive within the system for processing images of wayside equipment illustrated in FIG. 1.

In an exemplary embodiment of the present invention, the memory or other data storage 30 may further store one or more position parameters of the wayside equipment 14 at each expected position 32. The field of view 28 is adjusted based upon the one or more stored position parameters to collect the visible spectral data of the wayside equipment 14 positioned at the expected position 32. As illustrated in FIG. 2, once the locomotive 22 reaches an expected position 32 of the wayside equipment 14, the controller 24 is configured to align the video cameras 18,19 with the wayside equipment 14 based upon on the position parameters. Examples of such position parameters include a perpendicular distance 37 from a ground portion 39 to the light signal portion 27 of the wayside equipment 14 (FIG. 2), and a perpendicular distance 38 from a portion of the railroad 16 to the ground portion 39 (FIG. 5).

When the wayside equipment 14 is a light signal, the memory 30 is configured to store an expected color of the light signal positioned at the expected position 32. Additionally, the memory 30 is configured to store an expected profile of the light signal frame 43 at the expected position 32 and is further configured to store an expected position of the wayside equipment 14, such as the light signal having the expected color along the light signal frame 43 (FIG. 4). For example, as illustrated in FIG. 4, the memory 30 may store information indicating that the light signal portion 27 of the wayside equipment 14, such as the light signal along the light signal frame 43, is a pair of centered light signals along the light signal frame 43.

In an exemplary embodiment, the signal generated by the controller 24 is based upon comparing the expected color stored in the memory 30 with a detected color of the wayside equipment 14, and the signal is configured to switch the locomotive 22 into one of a motoring mode and a braking mode. The motoring mode is an operating mode in which energy from a locomotive engine 50 or an energy storage device 51 (FIGS. 1-2) is utilized in propelling the locomotive 22 along the railroad 16, as appreciated by one of skill in the art. The braking mode is an operating mode in which energy from a locomotive engine 50 or locomotive braking system is stored in the energy storage device 51 (FIG. 2). Although the embodiments illustrated in FIGS. 1-2 involve the signal generated by the controller 24 being sent to the engine 50 to switch the locomotive 22 into the motoring mode or the braking mode, the controller 24 may transmit the signal to the engine 50 to reduce the power notch setting or limit the power notch setting of the engine 50, for example. In addition, the controller 24 may transmit the signal to the memory 30, to record each signal and thus the performance of the system 10, for subsequent analysis. For example, after the locomotive 22 has completed a trip, the controller 24 signals stored in the memory 30 may be analyzed to determine whether the system 10 was executed properly. In addition, the controller 24 may transmit the signal to other devices within the system 10 to generate different responses based on the processing of the visible spectral data. For example, the controller 24 may transmit the signal to an audible warning device 60, such as a horn, for example. As another example, the controller 24 may transmit the signal to a headlight of the locomotive 22. Thus, the controller 24 may transmit the signal to any device within the locomotive 22, to initiate an action based upon the processing of the visible spectral data from the wayside equipment 14, such as the light signal. In an exemplary embodiment, if the controller 24 determines that the color of the wayside equipment 14, such as the light signal does not correspond with the expected color of the wayside equipment 14, such as the light signal stored in the memory 30, the controller 24 may transmit a signal to the engine 50 to initiate the braking mode to slow down the locomotive 22 or transmit a signal to the audible warning device 60, to alert the operator of a possible dangerous condition, for example.

In the exemplary embodiment where the wayside equipment 14 is a light signal, the video cameras 18,19 are configured to process a plurality of frames of the light signal portion 27 to determine if the wayside equipment 14, such as the light signal, is in one of a flashing mode and non-flashing mode. For example, the video cameras 18,19 would generate a multiple set of images 12, as illustrated in FIG. 4, and determine whether or not the light signals are flashing or not. The flashing mode may be indicative of a particular upcoming condition along the railroad, such as a dangerous condition, for example. In the locomotive 22 cabin, a single operator may be used to operate the locomotive. As stated above, in an exemplary embodiment, in response to the controller 24 determining that the light signal or other wayside equipment 14 is in the flashing mode indicative of a dangerous condition, the controller may transmit the signal to the engine 50 to initiate the braking mode, the motoring mode, to modify or limit a power notch setting, or transmit the signal to the audible warning device 60, to alert the operator of a possible dangerous condition, for example.

Figure 6:
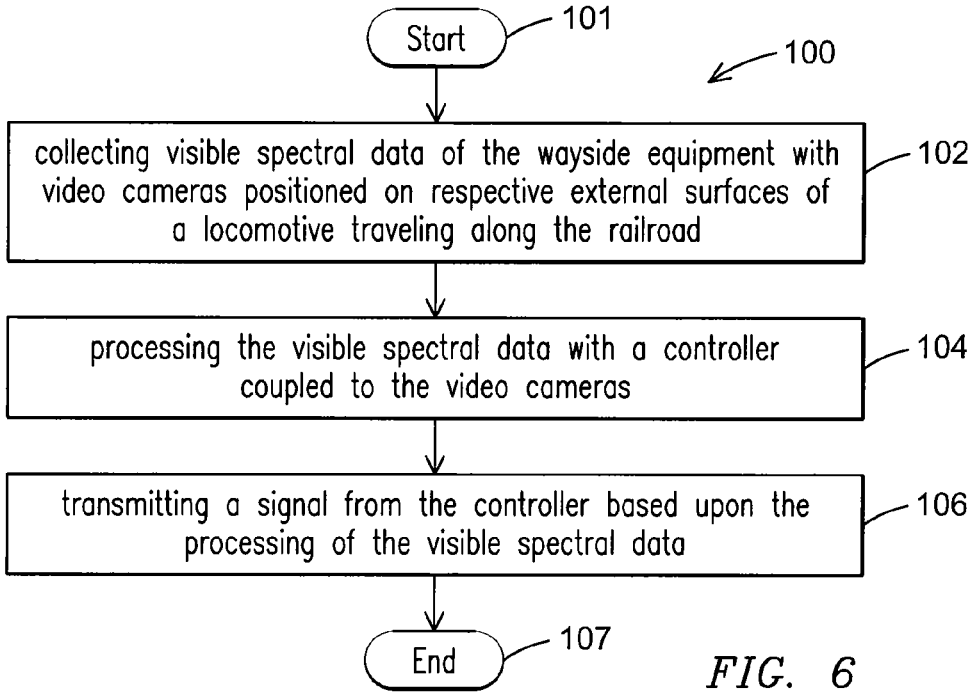
FIG. 6 is a flow chart illustrating an exemplary embodiment of a method for processing images of wayside equipment according to the present invention.

FIG. 6 illustrates an exemplary embodiment of a method 100 for processing images 12 of wayside equipment 14 adjacent to a railroad 16. The method 100 begins at 101 by collecting 102 visible spectral data of the wayside equipment 14 with video cameras 18,19 positioned on respective external surfaces 20,21 of a locomotive 22 traveling along the railroad 16. The method 100 further includes processing 104 the visible spectral data with a controller 24 coupled to the video cameras 18,19. The method 100 further includes transmitting 106 a signal from the controller 24 based upon processing of the visible spectral data, before ending at 107.

Figure 7:
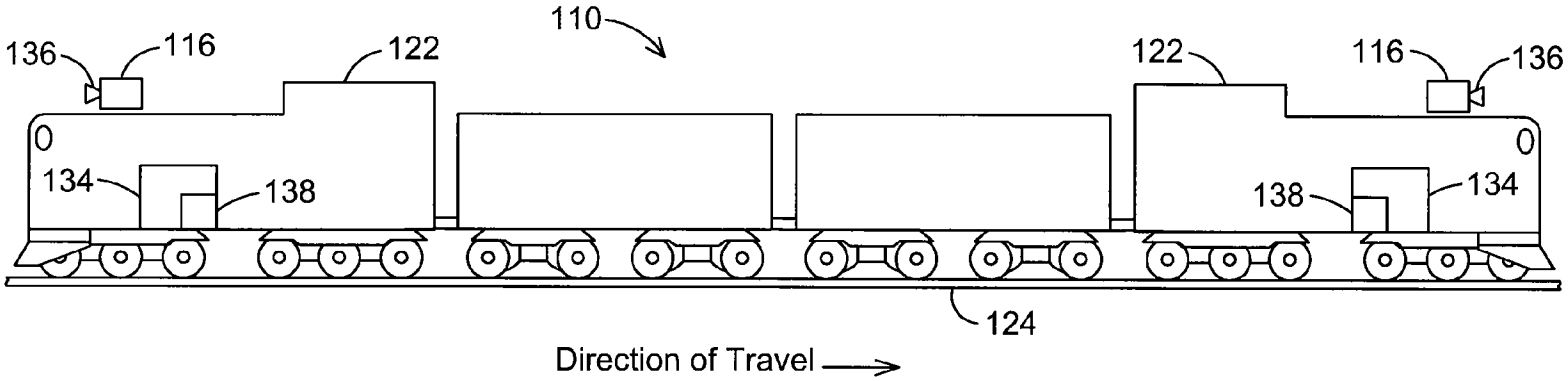
FIG. 7 is a side view of a locomotive within a system for determining an informational property of wayside equipment adjacent to a railroad, according to an exemplary embodiment of the present invention.
Figure 8:
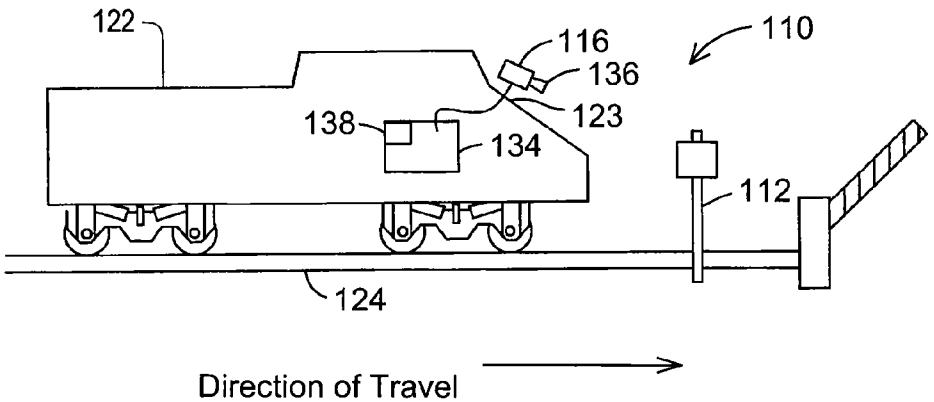
FIG. 8 is a side view of an exemplary embodiment of a locomotive within the system for determining an informational property of wayside equipment adjacent to a railroad illustrated in FIG. 7.
Figure 12:
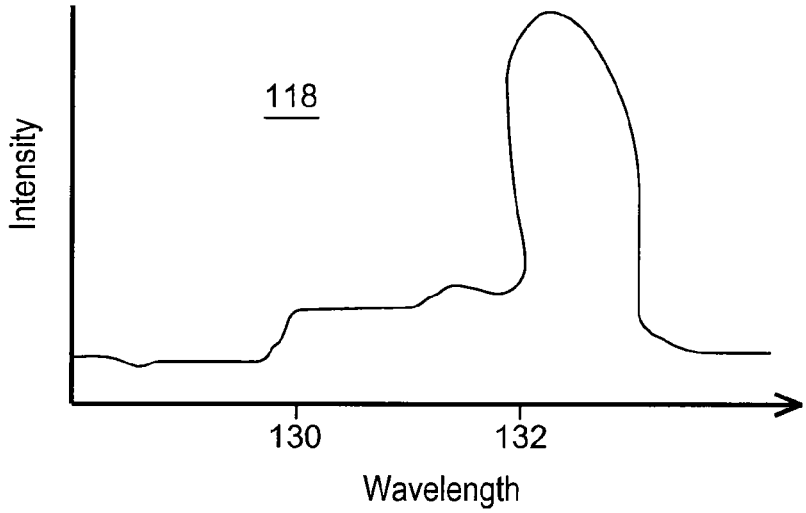
FIG. 12 is a plot of an exemplary embodiment of the intensity versus the spectral wavelength for the unfiltered spectral data illustrated in FIG. 10.
Figure 13:
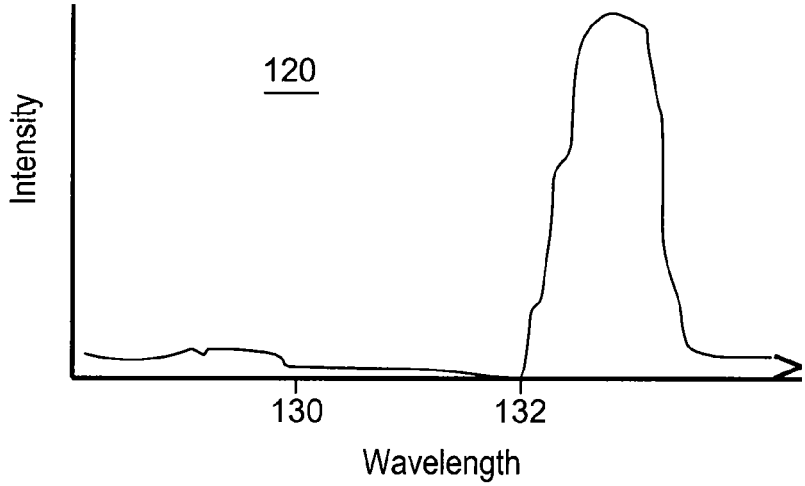
FIG. 13 is a plot of an exemplary embodiment of the intensity versus the spectral wavelength of filtered spectral data of FIG. 12 passed through one filter.

FIGS. 7-8 illustrate an exemplary embodiment of a system 110 for determining an informational property of wayside equipment 112 adjacent to a railroad 124. The system 110 includes a video camera 116 to collect visible spectral data 118,120,121 (FIGS. 12-14) of the wayside equipment 112. In the illustrated exemplary embodiment of FIG. 8, the video camera 116 is positioned on an external surface 123 of a locomotive 122 traveling along the railroad 124. As further illustrated in the exemplary embodiment of FIG. 8, the wayside equipment 112 is a light signal positioned adjacent to the railroad 124, and the system 110 may determine an informational property such as a color of the light signal, for example.

Figure 9:
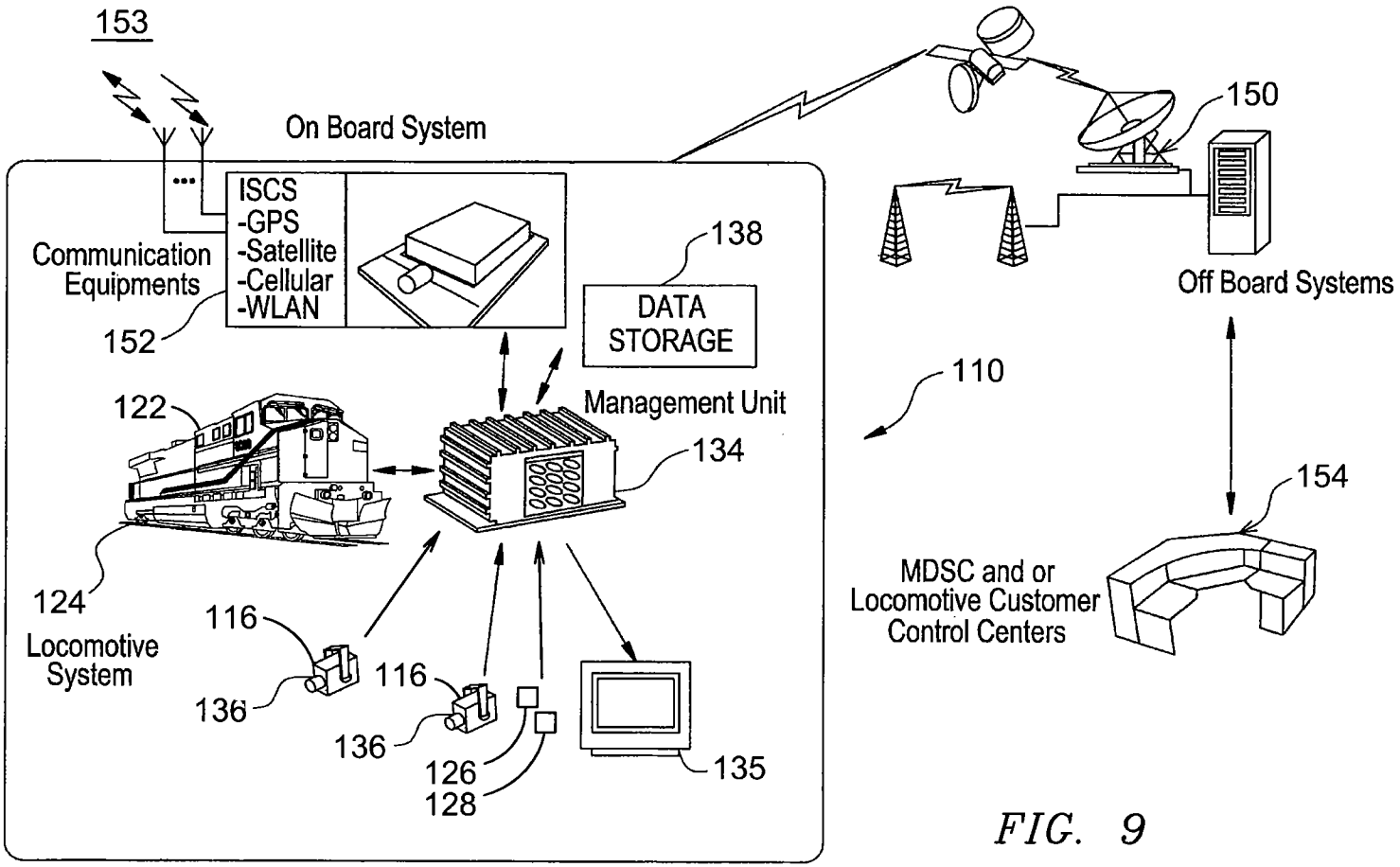
FIG. 9 is a schematic view of an exemplary embodiment of a system for determining an informational property of wayside equipment adjacent to a railroad according to the present invention.

As further illustrated in FIG. 9, the system 110 includes a plurality of filters 126,128, where the filters 126,128 are configured to filter a known portion 130,132 (FIGS. 12-14) of the visible spectral data 118,120,121 based upon known properties of the filters 126,128. Upon positioning one or more of the filters 126,128, the filter(s) is/are positioned between a lens 136 of the video camera 116 and the wayside equipment 112, in order to ensure that spectral data from the wayside equipment 112 passes through the filter(s) 126,128, prior to entering the video camera 116. In the exemplary embodiment of FIG. 9, the filters 126,128 may be color filters configured to filter a respective known portion 130,132 (FIGS. 12-14) of the visible spectrum, based upon known properties of the color filter.

Figure 10:
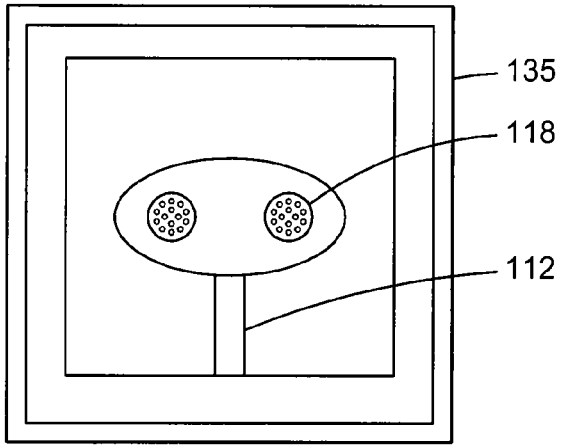
FIG. 10 is a front plan view of an exemplary embodiment of a monitor illustrating unfiltered spectral data from the wayside equipment illustrated in FIG. 8.

As further illustrated in the exemplary embodiment of FIGS. 8-9, a controller 134 is coupled to the video camera 116. The controller 134 is configured to compare unfiltered visible spectral data 118 (FIGS. 10,12), obtained prior to positioning the filters 126,128, with the filtered visible spectral data 120,121 (FIGS. 11, 13-14) obtained subsequent to positioning the filters 126,128. The controller 134 compares the unfiltered visible spectral data 118 and the filtered visible spectral data 120,121 in conjunction with the known properties of the filters 126,128 to determine the informational property of the wayside equipment 112, such as the color of a light signal, for example. The controller 134 may communicate this informational property of the wayside equipment 112 to an offboard system 150 using a wireless communication system 152 including one or more transceiver(s) 153, for example. The offboard system 150 may process the informational property of the wayside equipment 112, such as the colors of the light signals, and communicate this information to other locomotives in the vicinity of the locomotive 122, for example, or construct a real-time grid of the color indications of the light signals, for example, which would be accessible by all of the locomotive operators. Additionally, the offboard system 150 may share the informational properties of the wayside equipment 112 with a locomotive customer control center 154, which may ensure that the locomotive 122 abides by all safety precautions, for example.

The controller 134 is configured to store unfiltered visible spectral data 118 in a memory 138 prior to positioning the filters 126,128. Once the controller 134 compares the unfiltered visible spectral data 118 with the filtered spectral data 120,121, the controller 134 determines the color of the wayside equipment 112 light signal based upon a color of the unfiltered spectral data 118 being removed from the filtered spectral data 120,121. The color filters 126,128 are configured to filter a discrete respective known portion 130,132 of color within the visible spectral data based upon the known properties of the color filters 126,128. In the exemplary embodiment of FIGS. 10-14, the color filters 126,128 filter the discrete respective known portion 130,132 of green and red light within the visible spectral data, for example. However, the color filters may be configured to filter any discrete portion of the visible spectrum, and less than two or more than two color filters may be utilized in an exemplary embodiment of the system 110.

Figure 11:
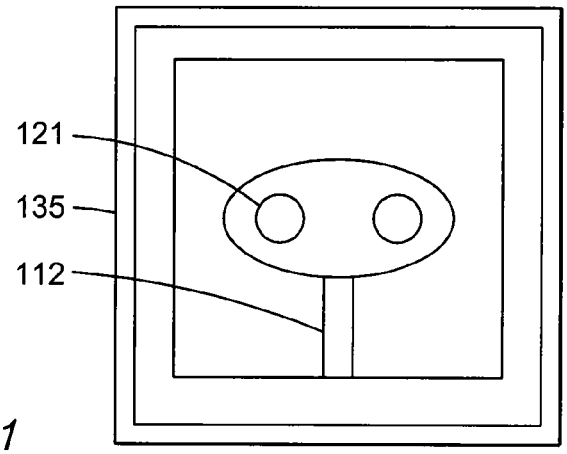
FIG. 11 is a front plan view of an exemplary embodiment of a monitor illustrating filtered spectral data from the wayside equipment illustrated in FIG. 8.
Figure 14:
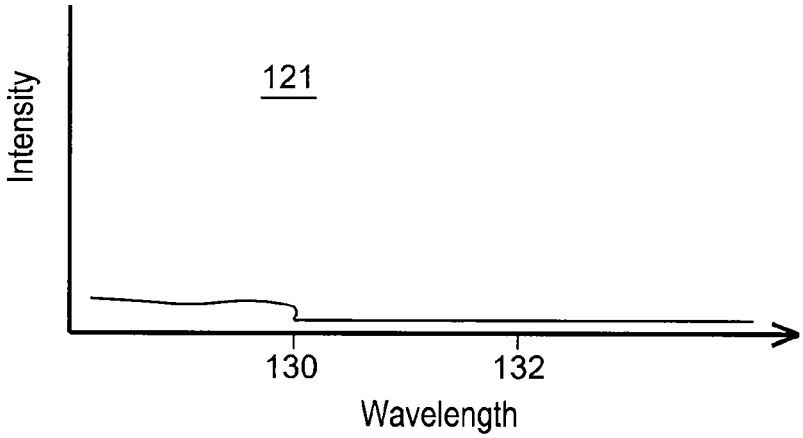
FIG. 14 is a plot of an exemplary embodiment of the intensity versus the spectral wavelength of filtered spectral data of FIG. 12 passed through two filters.

As illustrated in the exemplary embodiment of FIGS. 10-14, a display 135 illustrates an image of the wayside equipment 112 and the unfiltered spectral data 118 being emitted from the wayside equipment 112, such as a light signal, for example. The color filters 126,128 are individually consecutively positioned between the lens 136 and the wayside equipment 112 light signal until the filtered spectral data 121 has removed the color of the unfiltered spectral data 118 (FIG. 11). The controller 134 can determine the color of the wayside equipment 112 light signal and the unfiltered spectral data 118 by identifying the color of the filters 126,128 utilized to remove the color of the filtered spectral data 118. The controller 134 compares the unfiltered visible spectral data 118 with the filtered spectral data 120,121 for each respective individual filter 126,128. After the controller 134 recognizes the unfiltered spectral data 118 from the wayside equipment 112, without any color filters 126,128 positioned between the wayside equipment 112 and the lens 136 of the video camera 116, the controller 134 positions a color filter 126 between the wayside equipment 112 and the lens 136. The controller 134 may mechanically position a physical color filter, or electronically configure an electronic color filter to filter a discrete known portion 130 of the visible spectral data, for example. As discussed above, in the exemplary embodiment of FIGS. 10-14, the color filter 126 filters a discrete respective known portion 130 of green light within the visible spectral data. As a result, the filtered spectral data 120 (FIG. 13) subsequent to positioning the color filter 126 includes a noticeable decrease of intensity in the discrete known portion 130 of green light within the visible spectral data. The controller 134 compares the unfiltered spectral data 118 (FIG. 12) with the filtered spectral data 120 (FIG. 13), and determines if a common color or group of colors is present. In the exemplary embodiment, the controller 134 determines that the unfiltered spectral data 118 (FIG. 12) and filtered spectral data 120 (FIG. 13) include a common color of red, and thus the controller 134 positions a subsequent color filter 128 between the wayside equipment 112 and the lens 136 of the video camera 116. As discussed above, in the exemplary embodiment of FIGS. 10-14, the color filter 128 filters a discrete known portion 132 of red light within the visible spectral data. Upon positioning the color filter 128 between the wayside equipment 112 and the lens 136, the controller 134 compares the unfiltered spectral data 118 (FIG. 12) and the filtered spectral data 121 (FIG. 14). Since the unfiltered spectral data 118 and the filtered spectral data 121 do not include the common color of red found in the unfiltered spectral data 118, the controller 134 recognizes that the color of the unfiltered spectral data 118 coincides with the red color filter 128 which caused this red color to be removed in the filtered spectral data 121. Although the exemplary embodiment of FIGS. 10-14 discusses a red light signal as the wayside equipment 112, any color light signal may be utilized in conjunction with the system 110, and any type of color filters other than the green and red filters discussed above may be utilized.

Figure 15:
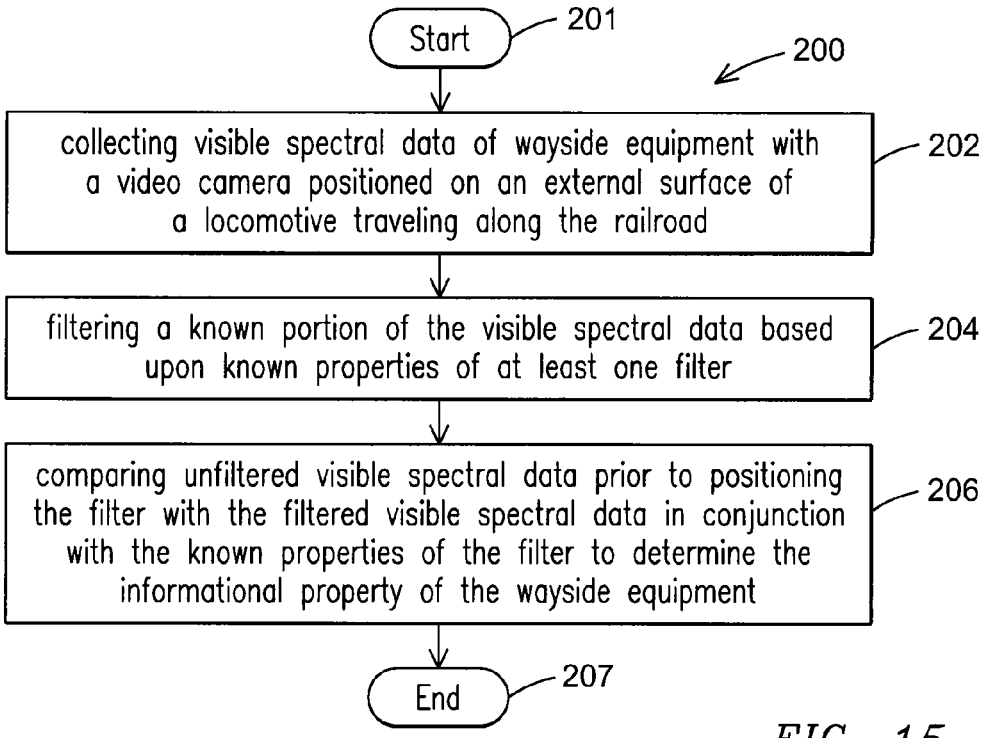
FIG. 15 is a flow chart illustrating an exemplary embodiment of a method for determining an informational property of wayside equipment adjacent to a railroad according to the present invention.

FIG. 15 illustrates an exemplary embodiment of a method 200 for determining an informational property of wayside equipment 112 adjacent to a railroad 124. The method 200 begins at 201 by collecting 202 visible spectral data 118 of the wayside equipment 112 with a video camera 116 positioned on an external surface 123 of a locomotive 122 traveling along the railroad 124. The method 200 further includes filtering 204 a known portion 130,132 of the visible spectral data 118 based upon known properties of at least one filter 126,128. (As should be appreciated, and as described above, "known property" refers to a characteristic or configuration of the filter for filtering visible spectral data, as known to the system. Thus, for example, if the known property of a filter is to filter red light in a particular range of wavelengths, then the filter will filter light in that manner.) The method 200 further includes comparing 206 unfiltered visible spectral data 118 prior to positioning the filter 126,128 with the filtered visible spectral data 120,121 in conjunction with the known properties of the filter 126,128 to determine the informational property of the wayside equipment 112, before ending at 207.

Although certain embodiments of the present invention have been described above with respect to video cameras, other image capture devices could be used instead if capable of capturing visible spectral data for filtering/processing in the manner described above. As such, unless otherwise stated herein, the term "camera" collectively refers to video cameras and other image capture devices for capturing visible spectral data.

Additionally, although certain embodiments of the present invention have been described above with respect to video cameras mounted on external surfaces of a vehicle, the invention contemplates and encompasses any cameras capable of capturing visible spectral data originating from sources external to the vehicle (e.g., wayside signal lights), and which typically are adjustable in terms of viewing angle for capturing spectral data from equipment located at expected positions.

Based on the foregoing specification, the above-discussed embodiments of the invention may be implemented using computer programming or engineering techniques including computer software, firmware, hardware or any combination or subset thereof, wherein the technical effect is to determine an informational property of wayside equipment adjacent to a railroad. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any emitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

Figure 16:
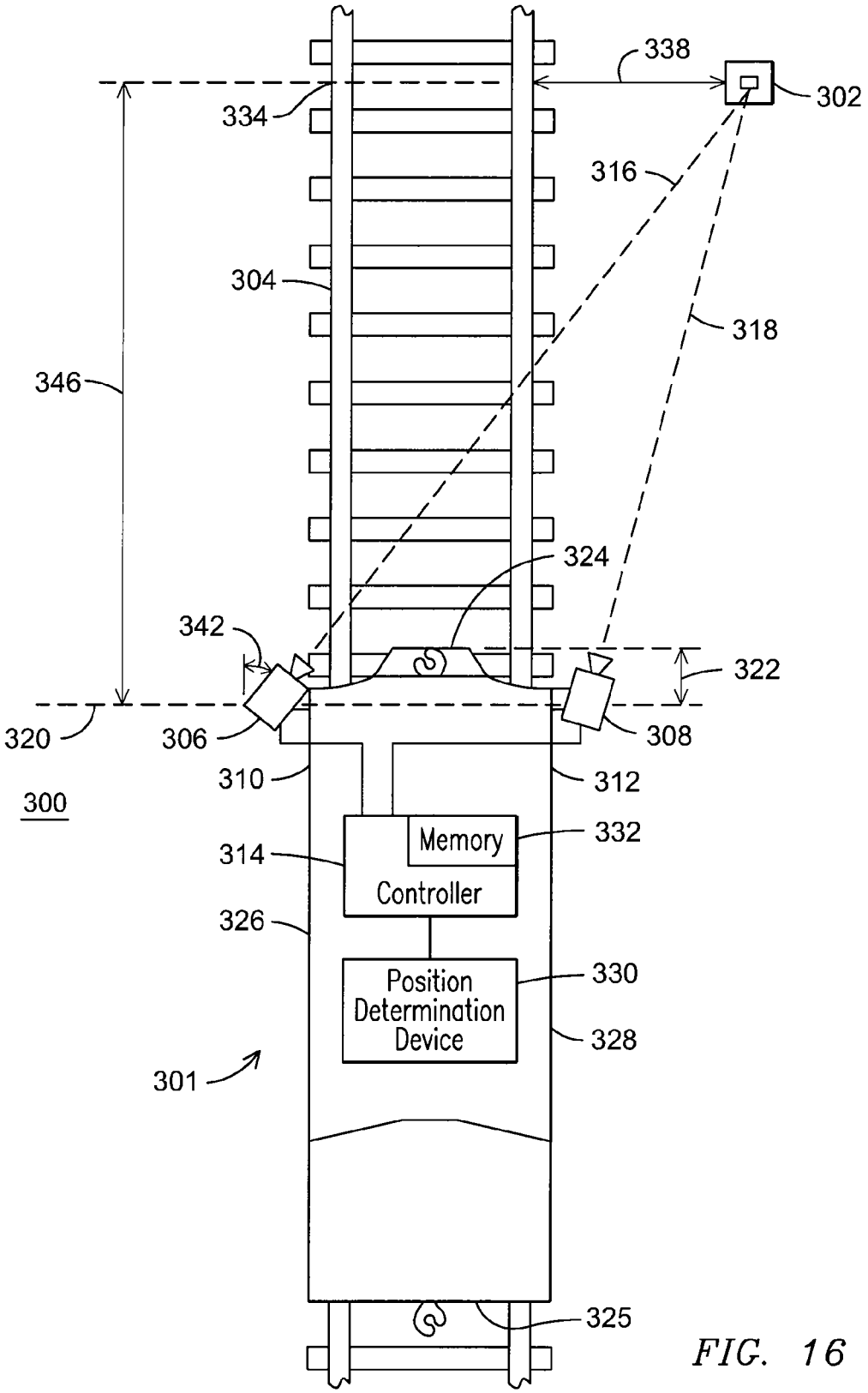
FIG. 16 is a top view of a locomotive within a system for determining a characteristic of an object positioned adjacent to a route, according to an exemplary embodiment of the present invention.

FIG. 16 illustrates an exemplary embodiment of a system 300 for determining a characteristic of an object, such as a railroad signal 302, for example, positioned adjacent to a route, such as a railroad 304, for example. However, the embodiments of the present invention are not limited to railroad signal objects, and may be utilized with any objects positioned adjacent to the route, such as wayside signals including railroad crossing signals, and mile marker signals, for example. The system 300 would determine such characteristics of these objects as: a status of the railroad crossing signal and a mileage reading of a mileage marker signal, for example, using the same techniques discussed below with regard to railroad signals. The characteristic of the railroad signal 302 is related to the operation of a powered system traveling along the route, such as a locomotive 301 traveling along the railroad 304, for example. In an exemplary embodiment, the color of a railroad signal 302 may be the characteristic of the railroad signal 302 to be determined, and this color may be related to the operation of the locomotive 301, such as whether the locomotive 301 should proceed past the railroad signal 302 or stop/slow down prior to reaching the railroad signal 302, for example. As discussed above with regard to the previous embodiments of the present invention illustrated in FIGS. 1-15, although the exemplary embodiments of the present invention illustrated in FIGS. 16-20, are described with respect to rail vehicles, or railway transportation systems, specifically trains and locomotives having diesel engines, exemplary embodiments of the invention are also applicable for other powered systems, such as but not limited to off-highway vehicles (OHV), marine vessels, agricultural vehicles, and transport buses, each which may use at least one diesel engine, or diesel internal combustion engine.

Figure 17:
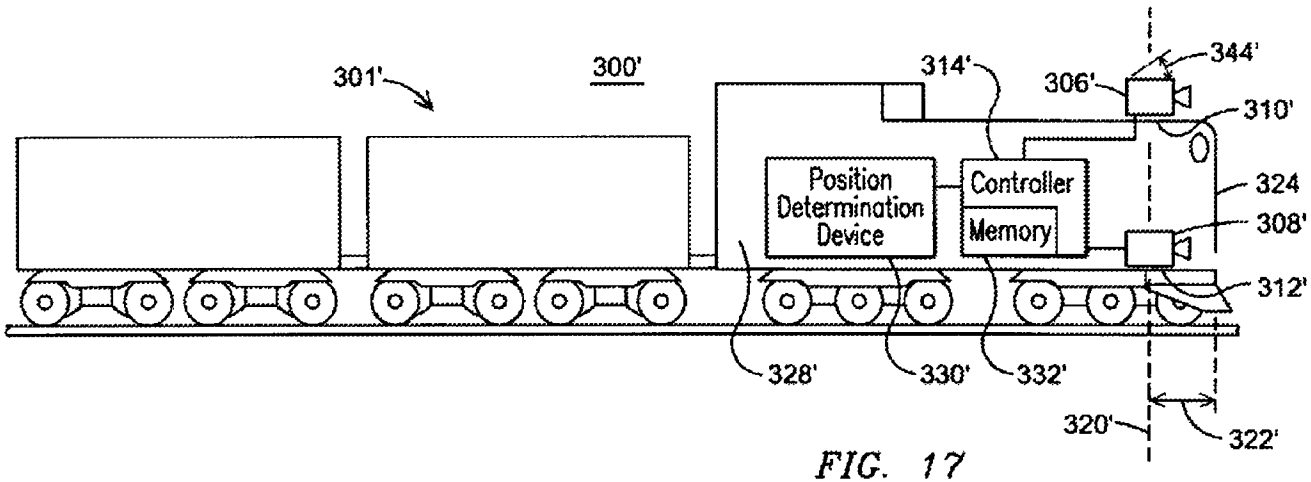
FIG. 17 is a top view of the locomotive within the system illustrated in FIG. 16, in which an obstacle has obstructed a camera mounted to the locomotive.

As illustrated in the exemplary embodiment of FIG. 16, the system 300 includes a pair of cameras 306,308 positioned at a respective external surface 310,312 of the locomotive 301. (Different from the embodiment shown in FIG. 1, the cameras 306,308 are connected to the same locomotive.) The respective external surfaces 310,312 are positioned within a common transverse plane 320 intersecting a fixed length position 322 along the length of the locomotive 301, and the respective external surfaces 310,312 are spaced within the transverse plane 320. The fixed length position 322 is the distance from the front 324 of the locomotive 301 at which the transverse plane 320 (typically aligned perpendicular to the railroad 304) spans the width of the locomotive 301. In the exemplary embodiment of FIG. 16, the fixed length position 322 is adjacent to and a relatively short distance from the front 324 of the locomotive 301, and thus the respective external surfaces 310,312 are positioned relatively proximate to the front 324 of the locomotive 301, and are further horizontally spaced adjacent to opposing sides 326,328 of the locomotive 301 within the transverse plane 320. In the exemplary embodiment of FIG. 17, the fixed length position 322' is also adjacent to the front 324' of the locomotive 301', except that the external surfaces 310',312' are vertically spaced along one side 328' of the locomotive 301' within the transverse plane 320'. Thus, the embodiment illustrated in FIG. 16 illustrates the pair of cameras 306,308 being horizontally spaced and positioned at respective external surfaces 310,312 on opposing sides 326,328 of the locomotive 301, while the embodiment illustrated in FIG. 17 illustrates the pair of cameras 306', 308' being vertically spaced and positioned at respective external surfaces 310',312' on a single side 328' of the locomotive 301'. The selection of the fixed length position, and the placement (horizontal or vertical) of the cameras 306,308 within the transverse plane 320 at the fixed length position 322 may be based on a particular travel distance along the railroad 304, such as whether railroad signals 302 are commonly positioned on one or both sides of the railroad 304, for example. Additionally, the fixed length position 322 may also be selected to be proximate to where an operator of the locomotive 301 is located, for example.

The fixed length position 322 may extend the length of the locomotive 301, in which case the fixed length position 322 would be adjacent to a rear 325 of the locomotive 301, and the respective external surfaces 310,312 would be positioned relatively proximate to the rear 325 of the locomotive 301 in the transverse plane 320. However, the fixed length position 322 may extend any length between the front 324 and rear 325 of the locomotive 301, and the respective external surfaces 310,312 may be positioned anywhere within the transverse plane 320, provided that the pair of cameras 306,308 can establish a respective line of sight 316,318 with the railroad signal 302. Although the above embodiment discusses that the respective external surfaces 310,312 are within a common transverse plane 320, the respective external surfaces 310,312 need not be positioned within a common transverse plane 320, and may be selectively located at any respective location on the exterior or interior of the locomotive 301, provided that the pair of cameras 306,308 are capable of establishing a respective line of sight 316,318 with the railroad signal 302. Additionally, within the transverse plane 320, the pair of cameras 306,308 need not be positioned on an external surface of the locomotive 301, and may be internally mounted within the locomotive 301, for example. Additionally, more than two cameras may be utilized in the embodiments of the present invention.

As further illustrated in FIG. 16, the system 300 includes a controller 314 on the locomotive 301, which is coupled to the pair of cameras 306,308. The controller 314 communicates with the pair of cameras 306,308 so to respectively align the pair of cameras 306,308 along the respective line of sight 316,318 to the railroad signal 302. Optionally, the system 300 includes a position determination device 330, such as a GPS receiver, for example, which is in communication with GPS satellites (not shown). The position determination device 330 is coupled to the controller 314 and is configured to determine a position of the locomotive 301 along the railroad 304, based on the communication with the GPS satellites. As appreciated by one of skill in the art, other types of position determination devices 330 may be employed such as a speed sensor (not shown) which is coupled to the controller 314 to determine the position of the locomotive 301 along the railroad 304, based on an elapsed time and speed data during the elapsed time, to determine a traveled distance from a known position. The controller 314 includes a memory 332, which stores various information, including a database of a position of the locomotive 301 along the railroad 304 based on the measured position of the position determination device 330. For example, the position determination device 330 may measure the raw position of the locomotive 301, in terms of latitude/longitude, which the controller 314 then uses to search the database in the memory 332 to determine the position of the locomotive 301 along the railroad 304. The memory 332 also includes a stored expected position 334 of railroad signals 302 along the railroad 304, and position parameters 338 of the railroad signal 302 at the expected position 334. As illustrated in the exemplary embodiment of FIG. 16, a position parameter 338 of the railroad signal 302 at the expected position 334 along the railroad 304 may be a perpendicular horizontal distance from a side edge of the railroad 304 to a base of the railroad signal 302, and indicate which side of the railroad 304 the perpendicular horizontal distance is measured, for example. In an exemplary embodiment, the position parameter 338 in FIG. 16 may be +5.6 feet, meaning that the base of the railroad signal 302 is positioned 5.6 feet from a side edge of the railroad 304, and the + sign may indicate that the distance is measured from the right rail of the railroad (using the locomotive frame of reference), if such a sign convention was to be employed, for example. Additionally, a position parameter 338 stored within the memory 332 may be a perpendicular vertical distance from the base of the railroad signal 302 to a top portion of the railroad signal 302, which emits visible spectral data that is captured by the pair of cameras 306,308. The cameras 306,308 transmit this visible spectral data to the controller 314, which is configured to determine a characteristic of the railroad signal 302, such as its color, using methods similar to those discussed above in the embodiments of FIGS. 7-15.

The controller 314 determines the respective line of sight 316,318 for the pair of cameras 306,308 to the railroad signal 302, based on one or more of: the position of the locomotive 301 along the railroad 304; the expected position 334 of the railroad signal 302 along the railroad 304; the fixed length position 322; the horizontal/vertical spacing of the cameras 306,308 within the transverse plane 320; and the position parameter(s) 338 of the railroad signal 302 at the expected position 334. Alternatively, the controller 314 may retrieve a predetermined line of sight 316,318 for the pair of cameras 306,308 from a look-up table in the memory 332, based on one or more of the above parameters of the locomotive 301 position, the expected position 334, the fixed length position 322, the horizontal/vertical spacing of the cameras 306,308, and the position parameter(s) 338, for example. For example, the controller 314 may determine an estimated distance to the railroad signal 302 (based on the position of the locomotive 301 and the expected position 334 of the railroad signal 302), and may determine a narrower line of sight 316,318 (e.g., the line of sight 316,318 collectively varies less from the direction of travel) of the cameras 306,308, based on a greater estimated distance to the railroad signal 302. Conversely, the controller 314 may determine a wider line of sight 316,318 (e.g., the line of sight 316,318 collectively varies more from the direction of travel) of the cameras 306,308, based on a lower estimated distance to the railroad signal 302. For example, a wider line of sight 316,318 of the cameras 306,308 may be determined, if the estimated distance to the railroad signal 302 is 100 yards, as opposed to 400 yards. Additionally, the controller 314 may consider the fixed length position 322, and spacing of the cameras 306,308 (horizontal or vertical) within the transverse plane 320, in determining the line of sight 316,318. The line of sight 316,318 of the cameras 306,308 positioned adjacent to the front 324 of the locomotive 301 will require a wider line of sight 316,318 than if the cameras 306,308 were positioned adjacent to the rear 325 of the locomotive 301, to the same railroad signal 302 at an expected position 334. Additionally, the vertical/horizontal spacing of the cameras 306,308 within the transverse plane 320 may be utilized in determining the line of sight 316,318, as it conveys to the controller 314 whether any of the camera 306,308 are available on a same side 326,328 of the locomotive 301 as the railroad signal 302 is positioned relative to the railroad 304. Thus, in the exemplary embodiment of FIG. 17, based on the position of the locomotive 301' and expected position of the railroad signal, the controller 314' may determine that the cameras 306', 308' have insufficient line of sight to capture video data from a railroad signal positioned on an opposite side of the railroad 304' as that side 328' of the locomotive 301' on which the cameras 306',308' are positioned. The controller 314 is further configured to continuously determine the line of sight 316,318, at incremental time intervals as the locomotive 301 travels along the railroad 304.

Upon determining the line of sight 316,318 of the cameras 306,308, or retrieving the predetermined line of sight 316,318 from the memory 332, the controller is configured to vary the alignment of the cameras 306,308 in accordance with the line of sight 316,318. As discussed above, the controller 314 determines the line of sight 316,318 at incremental time intervals, and thus continuously adjusts the alignment of the cameras 306,308 at each respective time interval, based on the respective line of sight 316,318 at that time interval. In varying the alignment of the cameras 306,308 in accordance with the determined respective line of sight 316,318, the controller 314 is configured to vary one of a horizontal alignment 342 (FIG. 16), for horizontally spaced cameras 306,308, or a vertical alignment 344' (FIG. 17), for vertically spaced cameras 306',308'. Of course, the controller 314 may simultaneously adjust the horizontal and vertical alignment of a single camera, depending on whether the placement of that camera on the external surface permits such an alignment. Upon aligning the pair of cameras 306,308 along the respective line of sight 316,318 to the railroad signal 302, the controller 314 may calculate a distance 346 from the locomotive 301 (adjacent to the external surfaces 310,312) to the railroad signal 302, based upon the respective line of sight 316,318 of the pair of cameras 306,308 to the railroad signal 302. For example, the pair of cameras 306,308 may be equipped with a transceiver capable of transmitting and receiving a signal, such as an infrared laser signal, for example. The controller 314 may simultaneously prompt the pair of cameras 306,308 to simultaneously transmit respective signals to the railroad signal 302, and simultaneously receive the reflected signal from the railroad signal 302. The pair of cameras 306,308 may include a processor that calculates the respective travel time of the respective signals to and from the railroad signal 302, and subsequently provides this travel time data to the controller 314. The controller 314 may then estimate the distance 346 from the locomotive 301 to the railroad signal 302, based on the travel time data provided by the pair of cameras 306,308, and the respective line of sight 316,318 of the pair of cameras 306,308. As appreciated by one of skill in the art, upon determining the respective distance between the cameras 306,308 and the railroad signal 302, the controller 314 may utilize equations of trigonometry with the line of sight 316,318 of each camera 306,308, in order to determine the distance 346 from the locomotive 301 to the railroad signal 302. For example, the controller 314 may use the two known distances of (1) the position parameter 338 and (2) the calculated distance along the line of sight 318, which form a right triangle with one length being the estimated distance 346, and thus the controller 314 may determine the estimated distance 346 using the Pythagorean theorem, for example. Additionally, the controller may use the two known distances of (1) the sum of the position parameter 338 and the width of the locomotive 301, and (2) the calculated distance along the line of sight 316 to similarly determine the estimated distance 346. The estimated distance 346 may be utilized by the controller 314 in the operation of the locomotive 301, such as in determining a braking distance and thus a required level of braking prior to a red colored railroad signal 302, for example.

Figure 18:
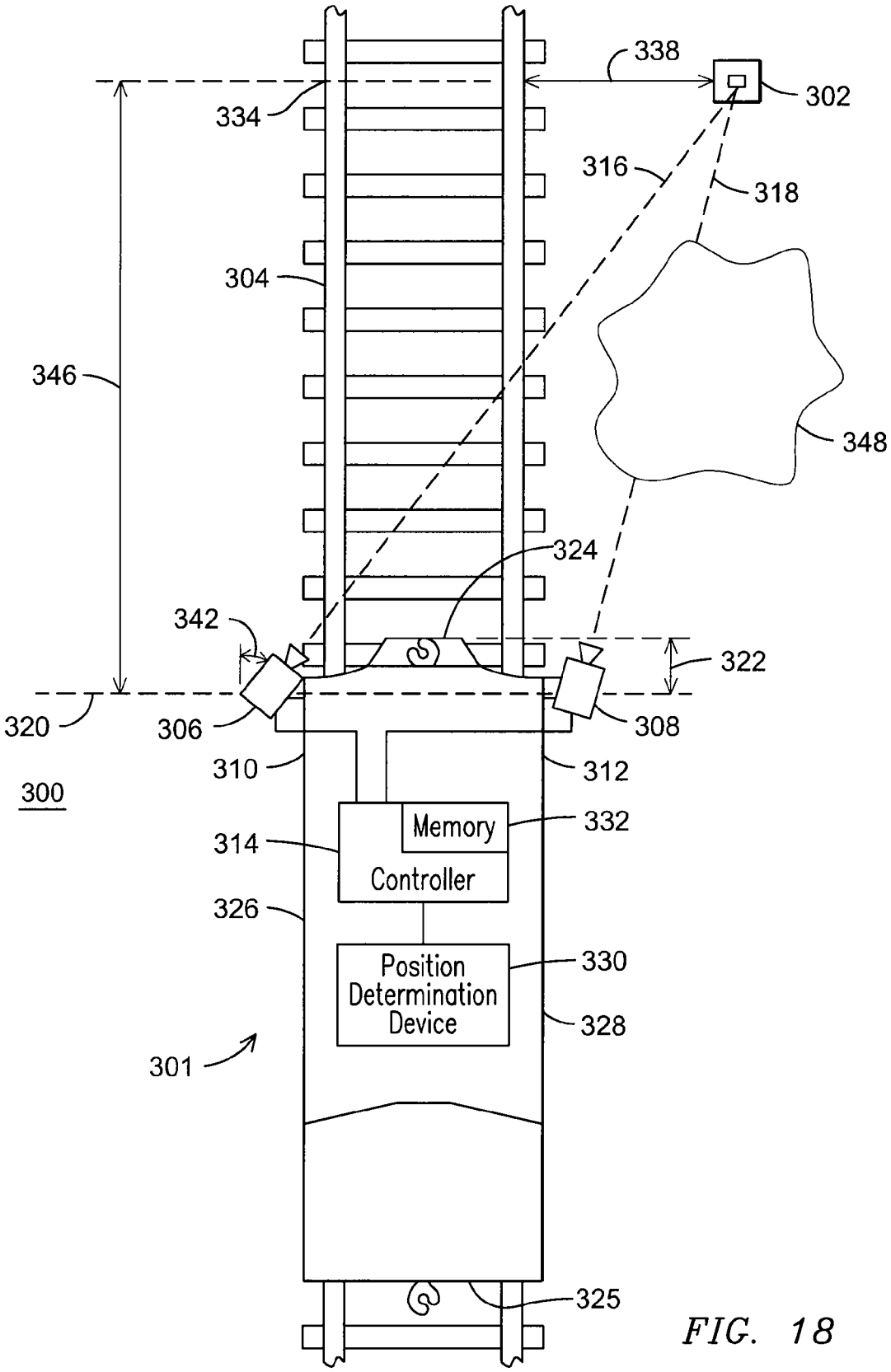
FIG. 18 is a side view of a locomotive within a system for determining a characteristic of an object positioned adjacent to a route, according to an exemplary embodiment of the present invention.

As illustrated in the exemplary embodiment of FIG. 18, upon aligning the pair of cameras 306,308 along the respective line of sight 316,318 to the railroad signal 302, an obstacle 348, such as a fog shroud, may obstruct the line of sight 318 of a camera 308 to the railroad signal 302. However, the line of sight 316 of a remaining camera 306 to the railroad signal 302 remains unobstructed by the obstacle 348. The camera 308 may transmit a signal to the controller 314, to alert the controller 314 that its line of sight 318 is obstructed by the obstacle 348, after which the controller 314 may determine whether the line of sight 316 of the remaining camera 306 is unobstructed by the obstacle 348. In the event that neither line of sight 316,318 is unobstructed by the obstacle 348, the controller 314 may switch to an alert mode to alert the locomotive operator that no video data of the railroad signal 302 is being captured for analysis. As discussed above with regard to the exemplary embodiment illustrated in FIG. 17, if the pair of cameras 306',308' are positioned on a side 328' of the locomotive 301' and the railroad signal is positioned adjacent an opposite side of the railroad, the side 328' of the locomotive 301' may itself be an obstacle to the lines of sight of the cameras 306',308'.

Figure 19:
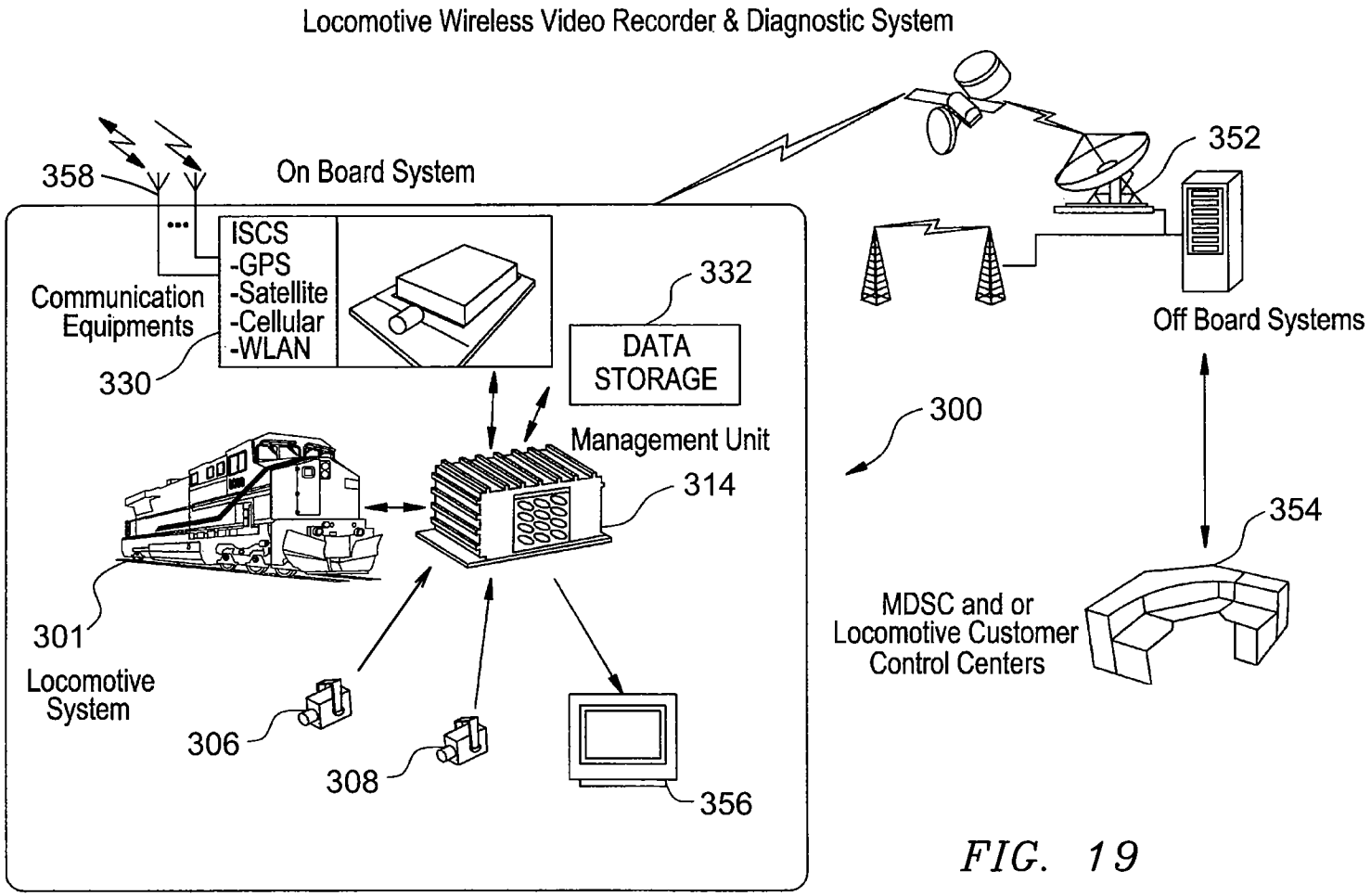
FIG. 19 is a schematic view of an exemplary embodiment of a system for determining a characteristic of an object positioned adjacent to a route, according to an exemplary embodiment of the present invention.

As illustrated in the exemplary embodiment of FIG. 19, a display 356 may be positioned on the locomotive 301, coupled to the controller 314, and configured to display the video data collected from the railroad signal 302, such as the determined color of the railroad signal 302, as discussed above in the embodiments of FIGS. 7-15, for example. Additionally, the position determination device 330 of the system 300 may include a transceiver 358 in communication with a remotely positioned off-board system 352. The off-board system 352 may transmit periodic updates to the memory 332, such as updated expected positions 334 of the railroad signals 302 along the railroad 304, updated predetermined lines of sight 316,318 based on one or more of the above discussed parameters, and/or updates to the database of the location of the locomotive 301 along the railroad 304, for example. Additionally, the transceiver 358 is coupled to the controller 314, and may transmit a determined characteristic of the railroad signal 302 to the off-board system 352, such as a color of the railroad signal 302, for example. Additionally, a locomotive customer control center 354 is in communication with the off-board system 352, and may receive and analyze the determined characteristics of the railroad signals 302, as determined by the controller 314, for example.

Figure 20:
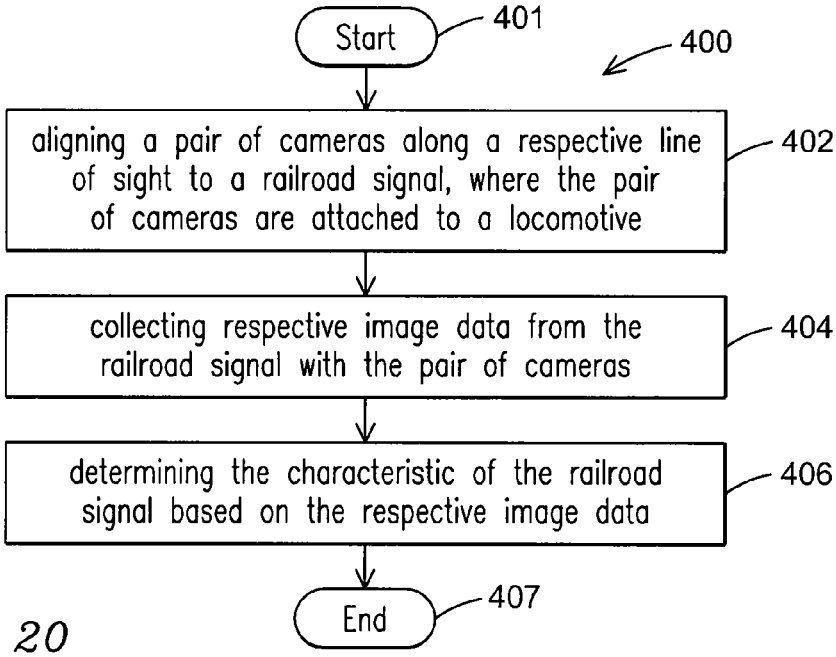
FIG. 20 is a flow chart illustrating an exemplary embodiment of a method for determining a characteristic of an object positioned adjacent to a route according to the present invention.

FIG. 20 illustrates an exemplary embodiment of a flowchart depicting a method 400 for determining a characteristic of an object, such as a railroad signal 302, for example, positioned adjacent to a route, such as a railroad 304, for example. The characteristic of the railroad signal 302 is related to the operation of a powered system traveling along the route, such as the color of the railroad signal 302 related to the operation of the locomotive 301 traveling along the railroad 304, for example. The method 400 begins at 401 by aligning 402 a pair of cameras 306,308 along a respective line of sight 316,318 to the railroad signal 302, where the pair of cameras 306,308 are attached to the locomotive 301. The method 400 further includes collecting 404 respective image data from the railroad signal 302 with the pair of cameras 306,308. The method 400 further includes determining 406 the characteristic of the railroad signal 302 based on the respective image data, before ending at 407.

Based on the foregoing specification, the above-discussed embodiments of the invention may be implemented using computer programming or engineering techniques including computer software, firmware, hardware or any combination or subset thereof, wherein the technical effect is to determine a characteristic of an object positioned adjacent to a route, where the characteristic of the object is related to the operation of a powered system traveling along the route. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any emitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A determination system comprising a plurality of cameras configured to be attached to a vehicle when the vehicle travels along a route, said cameras aligned along respective lines of sight to an object positioned adjacent to the route in order to determine at least one characteristic of the object, wherein the cameras are positioned at respective plural external surfaces of said vehicle within a common transverse plane that intersects a fixed length position along a length of said vehicle, said plural external surfaces being spaced within said transverse plane; a position determination device configured to determine a position of the vehicle along the route; and a controller configured to: determine an expected position of the object and at least one of a fixed length position of at least one of the cameras from a leading end of the vehicle along a direction of travel of the vehicle, a horizontal separation distance between the cameras, or a vertical separation distance between the cameras; align the plurality of cameras toward the object based on the position of the vehicle along the route, the expected position of the object, and the at least one of the fixed length position of at least one of the cameras, the horizontal separation distance between the cameras, or the vertical separation distance between the cameras.

2. The determination system of claim 1, wherein said vehicle is one of an off-highway vehicle, a marine vessel, transportation vehicle, agricultural vehicle, or a rail vehicle.

3. The determination system of claim 1, wherein the cameras are configured to collect respective visible spectral data from said object, and said controller is configured to determine the characteristic of said object based upon said visible spectral data.

4. The determination system of claim 1, wherein said fixed length position is adjacent to an end of the vehicle.

5. The determination system of claim 1, wherein said plurality of external surfaces are horizontally spaced apart from each other within said transverse plane, and the cameras are positioned adjacent to opposite sides of said vehicle.

6. The determination system of claim 1, wherein said plurality of external surfaces are disposed at different vertical heights within said transverse plane, and the cameras are positioned adjacent to one side of said vehicle.

7. The determination system of claim 1, further comprising:

wherein said controller includes a memory configured to store the expected position of said object along the route and at least one position parameter of said object at said expected position; and said controller is further configured to determine the respective lines of sight for the cameras to said object based on said at least one position parameter of said object at said expected position.

8. The determination system of claim 7, wherein said at least one position parameter is one or more of a vertical distance between a ground and the object or a horizontal distance between the route and the object.

9. The determination system of claim 7, wherein upon determining the respective lines of sight for the cameras, said controller is configured to align the cameras along the respective lines of sight to the object by varying at least one of a horizontal alignment or a vertical alignment of the respective cameras along the respective lines of sight to the object.

10. The determination system of claim 7, wherein upon aligning the cameras along the respective lines of sight to the object, said controller is configured to calculate a distance from the vehicle to the object based upon the respective lines of sight of the respective cameras to the object.

11. The determination system of claim 7, wherein upon aligning said respective cameras along the respective lines of sight to the object, and upon an obstacle obstructing said line of sight of a first camera of the cameras to said object, said line of sight of a second camera of the cameras to said object remains unobstructed to said object.

12. The determination system of claim 11, wherein said obstacle is a fog shroud surrounding a portion of said object coinciding with said line of sight of said first camera to said object.

13. The determination system of claim 7, wherein the controller is configured to generate an alert to notify an operator of the vehicle when all of the lines of sight of the cameras to the object are obstructed.

14. The determination system of claim 1, wherein said vehicle is a rail vehicle traveling along a first track, the cameras include a pair of cameras having a pair of camera locations on respective opposite sides of said rail vehicle.

15. The determination system of claim 14, wherein said pair of cameras is configured to determine whether a second track is positioned on at least one side of said first track.

16. The determination system of claim 1, wherein the object is a light signal positioned adjacent to the route, and the cameras are aligned along the respective lines of sight to said light signal to collect visible spectral data from the light signal.

17. The determination system of claim 16, wherein the cameras are configured to acquire unfiltered data of the visible spectral data from the light signal and filtered data of the visible spectral data from the light signal, and the controller is configured to compare the unfiltered data with the filtered data in order to identify a color of a light emitted by the light signal.

18. The determination system of claim 17, wherein the filtered data includes a portion of the visible spectral data that does not include one or more colors that are filtered by a filter disposed between at least one of the cameras and the object.

19. A method comprising:

identifying a position of a vehicle traveling along a route, the vehicle having plural cameras connected to the vehicle in different locations;

determining an expected position of an object disposed alongside the route and at least one of a fixed length position of at least one of the cameras from a leading end of the vehicle along a direction of travel of the vehicle, a horizontal separation distance between the cameras, or a vertical separation distance between the cameras;

aligning the cameras along respective lines of sight to said object based on the position of the vehicle that is identified, the expected position of the object, and the at least one of the fixed length position, the horizontal separation distance, or the vertical separation distance;

collecting respective image data from said object with the cameras; and determining at least one characteristic of said the object based upon said image data.

20. The method of claim 19, wherein the cameras are attached at respective ones of plural external surfaces of the vehicle, said vehicle being one of an off-highway vehicle, a marine vessel, a transportation vehicle, an agricultural vehicle, or a rail vehicle.

21. The method of claim 19, further comprising:

determining at least one position parameter of the object; and determining the respective lines of sight for the cameras to said object based on the at least one position parameter of said object at said expected position.

22. The method of claim 19, further comprising generating an alert to notify an operator of the vehicle when all of the lines of sight of the cameras to the object are obstructed.

23. The method of claim 19, wherein the object is a light signal positioned adjacent to the route, and collecting the image data from the object includes collecting visible spectral data from the light signal.

24. The method of claim 19, wherein collecting the image data includes acquiring unfiltered data of the visible spectral data from the light signal and filtered data of the visible spectral data from the light signal, and wherein the at least one characteristic of the object that is determined is a color of a light emitted by the light signal based on a comparison of the unfiltered data and the filtered data.

25. The method of claim 24, wherein the filtered data includes a portion of the visible spectral data that does not include one or more colors that are filtered by a filter disposed between at least one of the cameras and the object.

26. A determination system comprising:

a plurality of cameras configured to be attached to a rail vehicle; and a position determination device configured to determine a position of the vehicle along a track; and a controller configured to be connected with the plurality of cameras and to adjust the plurality of cameras for alignment along a respective lines of sight to wayside equipment disposed alongside the track being traveled by the rail vehicle, wherein the controller is configured to align the plurality of cameras toward the wayside equipment based on the position of the vehicle along the track, an expected position of the wayside equipment and at least one of a fixed length position of at least one of the cameras from a leading end of the vehicle along a direction of travel of the vehicle, a horizontal separation distance between the cameras, or a vertical separation distance between the cameras.

27. The determination system of claim 26, wherein said plurality of cameras are positioned at respective external surfaces of said rail vehicle that are positioned within a common transverse plane intersecting a fixed length position along a length of said rail vehicle, said plurality of external surfaces being spaced within said transverse plane.

28. The determination system of claim 27, wherein said fixed length position is adjacent to an end of the rail vehicle.

29. The determination system of claim 27, wherein said plurality of external surfaces are horizontally spaced within said transverse plane, said plurality of cameras being positioned adjacent to opposite sides of said rail vehicle.

30. The determination system of claim 27, wherein said plurality of external surfaces are vertically spaced within said transverse plane, said plurality of cameras being positioned adjacent to one side of said rail vehicle.

31. A non-transitory computer readable medium for determining at least one characteristic of an object positioned alongside a route, said characteristic of the object being related to an operation of a vehicle having plural attached cameras and traveling along the route, said non-transitory computer readable medium including computer software code, that, when executed on a processor, causes the processor to:

identify a position of the vehicle along the route;

determine an expected position of the object and at least one of a fixed length position of at least one of the cameras from a leading end of the vehicle along a direction of travel of the vehicle, a horizontal separation distance between the cameras, or a vertical separation distance between the cameras; and align said cameras along respective lines of sight to said object based on the position of the vehicle, the expected position of the object, and the at least one of the fixed length position, the horizontal separation distance, or the vertical separation distance.

* * * * *